US009469920B2

(12) United States Patent
Lee et al.

(10) Patent No.: US 9,469,920 B2
(45) Date of Patent: Oct. 18, 2016

(54) ELECTROSPINNING DEVICE

(75) Inventors: Min Wook Lee, Seoul (KR); Suk Goo Yoon, Seoul (KR); Alexander L Yarin, Chicago, IL (US); Suman Sinha-Ray, Chicago, IL (US); Behnam Pourdeyhimi, Raleigh, NC (US)

(73) Assignees: KOREA UNIVERSITY RESEARCH AND BUSINESS FOUNDATION, Seoul (KR); NORTH CAROLINA STATE UNIVERSITY, Raleigh, NC (US); BOARD OF TRUSTEES OF THE UNIVERSITY OF ILLINOIS, Urbana, IL (US)

( * ) Notice: Subject to any disclaimer, the term of this patent is extended or adjusted under 35 U.S.C. 154(b) by 65 days.

(21) Appl. No.: 14/351,731

(22) PCT Filed: Jun. 17, 2012

(86) PCT No.: PCT/KR2012/004803

§ 371 (c)(1),
(2), (4) Date: Apr. 14, 2014

(87) PCT Pub. No.: WO2013/055003

PCT Pub. Date: Apr. 18, 2013

(65) Prior Publication Data

US 2014/0234457 A1 Aug. 21, 2014

(30) Foreign Application Priority Data

Oct. 12, 2011 (KR) ..... 10-2011-0104222
Mar. 22, 2012 (KR) ..... 10-2012-0029142

(51) Int. Cl.

| | |
|---|---|
| ***D01D 7/02*** | (2006.01) |
| ***D04H 1/728*** | (2012.01) |
| ***D01D 5/00*** | (2006.01) |
| ***D01D 5/14*** | (2006.01) |

(52) U.S. Cl.

CPC ..... *D01D 5/0092* (2013.01); *D01D 5/0007* (2013.01); *D01D 5/0061* (2013.01); *D01D 5/14* (2013.01); *D04H 1/728* (2013.01)

(58) Field of Classification Search

CPC ..... D01D 5/0092; D01D 5/0061; D01D 5/0007; D01D 5/14

USPC ..... 425/73–74, 83.1, 174.2, 382.2, 404, 425/445, 464

See application file for complete search history.

(56) References Cited

U.S. PATENT DOCUMENTS

| | | | | |
|---|---|---|---|---|
| 7,931,457 | B2 * | 4/2011 | Johnson | D01D 4/025 425/72.2 |
| 8,186,987 | B2 * | 5/2012 | Sumida | D01D 5/0061 425/382.2 |
| 8,383,539 | B2 * | 2/2013 | Sumida | D01D 5/0061 264/465 |

FOREIGN PATENT DOCUMENTS

| | | | |
|---|---|---|---|
| JP | 2005-264374 | A | 9/2005 |
| KR | 2003-0077384 | A | 10/2003 |
| KR | 2006-0025290 | A | 3/2006 |
| KR | 2006-0079211 | A | 7/2006 |
| KR | 2010-0011603 | A | 2/2010 |
| KR | 2010-0011606 | A | 2/2010 |

* cited by examiner

*Primary Examiner* — Joseph S. Del Sole
*Assistant Examiner* — Thukhanh T Nguyen
(74) *Attorney, Agent, or Firm* — Rabin & Berdo, P.C.

(57) ABSTRACT

The present invention relates to an electrospinning device. The electrospinning device may apply the force of a supersonic flow acting at a predetermined angle with respect to an electrostatic force on a fiber discharged from an electrospinning nozzle to cause shearing stress on the fiber, thereby providing fibers having a very small diameter and collecting fibers having a finer diameter. Also, the electrospinning device may collect finer and more uniform fibers by adjusting the relative positions of the electrospinning nozzle for discharging the fiber and a gas spray nozzle for spraying a gas.

8 Claims, 14 Drawing Sheets

| S1 | S1 | S2 | S3 |
|---|---|---|---|
| CONDITION 1 | 2.0mm | 0 | 23.5cm |
| CONDITION 2 | 2.5cm | 1.5cm | 23.5cm |

| | V [kV] | S1 [cm] | S2 [cm] | S3 [cm] | df |
|---|---|---|---|---|---|
| CONDITION 1 | 20 | 1.5 | 1.0 | 23.5 | ~100nm |
| CONDITION 2 | 13.5 | 0.7 | 1.0 | 23.5 | 50~100nm |
| CONDITION 3 | 10 | 0.7 | 0 | 23.5 | 100nm~ |
| CONDITION 4 | 11 | 1.5 | 0 | 23.5 | ~100nm |
| CONDITION 5 | 8 | 0 | 0 | 23.5 | ~200nm |

* NYLON 20 wt%

| | V [kV] | S1 [cm] | S2 [cm] | S3 [cm] | NYLON (wt%) | df |
|---|---|---|---|---|---|---|
| CONDITION 1 | 17.5 | 1.5 | 1.0 | 23.5 | 10 | |
| CONDITION 2 | 17.5 | 1.5 | 0 | 23.5 | 10 | |
| CONDITION 3 | 11.0 | 0.7 | 1.0 | 23.5 | 10 | 50~100nm |
| CONDITION 4 | 9.0 | 0.7 | 1.0 | 23.5 | 15 | 50~100nm |
| CONDITION 5 | 10.5 | 1.5 | 1.0 | 23.5 | 15 | 40~50nm |
| CONDITION 6 | 12.0 | 1.5 | 0 | 23.5 | 15 | |

* NYLON 10 wt%, 15 wt%

ELECTROSPINNING DEVICE

TECHNICAL FIELD

The present invention relates to an electrospinning device, and more particularly, to an electrospinning device in which a supersonic flow force acting at a predetermined angle with respect to an electrostatic force is applied to a fiber discharged from an electrospinning nozzle to cause a shear stress to be applied to the fiber, so that a diameter of the fiber can be made smaller, and thus fibers having a finer diameter can be collected. Also, the present invention relates to an electrospinning device in which finer and more uniform fibers can be collected by adjusting the relative positions of an electrospinning nozzle for discharging a fiber and a gas spray nozzle for spraying a gas.

BACKGROUND ART

Electrospinning is a technology that produces a supermicro fiber having a diameter ranging from several tens to several hundreds of nanometers. Electrospinning is regarded as being the most advantageous in terms of industrialization because its principle and equipment is simpler and its application is easier compared to other nanofiber production methods. When an electric force is applied to a polymer solution dissolved in a melt or a solvent, electric charges are induced on a liquid surface of a polymer solution formed at the tip of a spinning nozzle or spinneret by a surface tension and a mutual repulsive force between the induced electric charges is produced in an opposite direction to that of the surface tension. When a threshold voltage exceeding the surface tension of the pedant droplet of the polymer solution is applied, a charged jet of the polymer solution formed by an electric repulsive force escapes from the tip of the spinning nozzle. The ejected jet develops a whipping motion in which the jet is ripped into thin strips so as to be fiberized and the solvent evaporates while flying in the air, thereby forming a nonwoven web in which supermicro fibers are laminated on a collector. Thus formed electrospun web can have breathability due to its numerous microporous structures, but have the characteristics of flexibility, ultra thinness, and ultra lightweightness as consisting of fiber assemblies having a diameter of a nanometer unit.

Since the fibers prepared by such an electrospinning technology can be potentially used in a wide range of applications, including filtrations, optical fibers, protective textures, drug delivery systems, tissue engineering frameworks, and gas separation membranes, their intensive scientific research is in progress.

In addition, thus prepared fibers have a diameter ranging from several micrometers to several nanometers depending on the preparation conditions, a very large surface area per unit mass, and flexibility. This suggests a possibility that the electrospun fibers will be used as adsorption agents. The characteristics of a number of voids formed between fibers and great dispersion of the fibers to an external stress suggest a possibility that the electrospun fibers will be used as efficient adsorption membranes, as their fluidity will be excellent and their structure will not be destroyed due to the flow.

Korean Patent Laid-Open Publication No. 2003-0077384 discloses an electro-brown spinning process of preparing a nanofiber web, in which a polymer solution is discharged through a spinning nozzle applied with a high voltage while compressed air is sprayed through a lower end of the spinning nozzle so that spun fibers are collected in the form of a web on a collector disposed below the spinning nozzle and grounded to the earth. However, this conventional method entails a problem in that the fiber discharged by the compressed air with high pressure and speed collide with and rebound from the surface of the collector, thereby contaminating the nozzle. In addition, there is involved a problem in that in case of spinning the polymer solution, the fibers are highly likely to be embrittled due to recovery of a solvent, and the amount of the polymer solution discharged is reduced as much as the amount of the solvent recycled, thereby reducing the production amount of the fibers.

In particular, the fiber preparation technology using a general electrospinning method according to the prior art has a limitation in that micro fibers with a diameter of 100 nm or less are not uniformly collected, and thus encounter a drawback in that its application range is significantly limited.

DISCLOSURE OF INVENTION

Technical Problem

Accordingly, the present invention has been made to solve the above-mentioned problems occurring in the prior art, and it is an object of the present invention to provide an electrospinning device in which a supersonic flow force acting at a predetermined angle with respect to an electrostatic force is applied to a fiber discharged from an electrospinning nozzle to cause a shear stress to be applied to the fiber, so that a diameter of the fiber can be made smaller, and thus fibers having a finer diameter can be collected.

Another object of the present invention is to provide an electrospinning device in which finer and more uniform fibers can be collected by adjusting the relative positions of an electrospinning nozzle for discharging a fiber and a gas spray nozzle for spraying a gas.

Technical Solution

To achieve the above object, in one aspect, the present invention provides an electrospinning device including: an electrospinning nozzle configured to discharge a polymer spinning solution by being applied with a high voltage in such a manner that the polymer spinning solution forms a fiber; a high voltage generator configured to apply a high voltage to the electrospinning nozzle; a ground power source configured to form an electric field in a space between the electrospinning nozzle and the ground power source so that the fiber discharged from the electrospinning nozzle is induced to flow in a predetermined direction by an electrostatic force; a gas spray nozzle configured to spray a gas in one direction; and a collector configured to collect the fiber discharged from the electrospinning nozzle thereon, wherein the collector is disposed at a position opposed to that of the gas spray nozzle along the flow direction of the gas sprayed from the gas spray nozzle, and the fiber discharged from the electrospinning nozzle is collected on the collector by the flow force of the gas sprayed from the gas spray nozzle.

In the electrospinning device, the ground power source may be connected to the gas spray nozzle so that the fiber discharged from the electrospinning nozzle is induced to flow toward the gas spray nozzle by the electrostatic force.

Also, in the electrospinning device, the ground power source may be connected to a separate ground plate so that the fiber discharged from the electrospinning nozzle is induced to flow toward the ground plate by the electrostatic force.

In the meantime, in the electrospinning device, the gas spray nozzle may be configured to spray the gas at supersonic flow speed.

In addition, in the electrospinning device, the direction of the electrostatic force by the electric field acting on the fiber discharged from the electrospinning nozzle and the direction of the flow force of the gas sprayed from the gas spray nozzle may be formed so as to be perpendicular to each other.

Further, in the electrospinning device, the electrospinning nozzle may be disposed in such a manner as to be spaced apart from a flow layer of the gas sprayed from the gas spray nozzle.

Moreover, in the electrospinning device, the fiber discharged from the electrospinning nozzle may be positioned adjacent to the gas spray nozzle relative to the flow direction of the gas sprayed from the gas spray nozzle.

In another aspect, the present invention also provides an electrospinning device including: an electrospinning nozzle configured to discharge a polymer spinning solution by being applied with a high voltage in such a manner that the polymer spinning solution forms a fiber; a high voltage generator configured to apply a high voltage to the electrospinning nozzle; a ground power source configured to form an electric field in a space between the electrospinning nozzle and the ground power source so that the fiber discharged from the electrospinning nozzle is induced to flow in a predetermined direction by an electrostatic force; a gas spray nozzle configured to spray a gas in one direction; a collector configured to collect the fiber discharged from the electrospinning nozzle thereon, wherein the collector is disposed at a position opposed to that of the gas spray nozzle along the flow direction of the gas sprayed from the gas spray nozzle, and the fiber discharged from the electrospinning nozzle is collected on the collector by the flow force of the gas sprayed from the gas spray nozzle, wherein a nozzle ground unit is disposed at the outside of the gas spray nozzle in such a manner as to be connected to the ground power source, and wherein the ground power source is connected to the nozzle ground unit so that the fiber discharged from the electrospinning nozzle is induced to flow toward the gas spray nozzle by the electrostatic force.

In the electrospinning device, the nozzle ground unit may be provided in plural numbers such that the plural nozzle ground units are disposed concentrically with respect to the gas spray nozzle, and the nozzle ground unit and the ground power source may be connected to each other in an interruptible manner.

In the electrospinning device, the nozzle ground unit may be provided in plural numbers such that the plural nozzle ground units are concentrically disposed relative to the gas spray nozzle, and the number of the electrospinning nozzle may be the same as that of the nozzle ground unit and the electrospinning nozzles may be disposed circumferentially relative to and equidistantly from the gas spray nozzle in such a manner that the electrospinning nozzles and the nozzle ground units are interlaced with each other.

In the electrospinning device, each of the electrospinning nozzles may form a pair together with an associated one of the nozzle ground units that are disposed circumferentially around the gas spray nozzle in such a manner as to be interlaced with the electrospinning nozzles, so that each pair consisting of one electrospinning nozzle and one nozzle ground unit can be selectively operated.

Advantageous Effects

The electrospinning device according to the embodiment of the present invention having the configuration as described above have the following advantageous effects.

A gas spray nozzle is mounted such that a supersonic flow force acting at a right angle with respect to an electrostatic force is applied to a fiber discharged from an electrospinning nozzle to cause a shear stress to be applied to the fiber, so that a diameter of the fiber can be made smaller, and thus fibers having a finer diameter can be collected uniformly.

In addition, finer and more uniform fibers can be collected by adjusting the relative positions of an electrospinning nozzle for discharging a fiber and a gas spray nozzle for spraying a gas.

BRIEF DESCRIPTION OF THE DRAWINGS

The above and other objects, features and advantages of the present invention will be apparent from the following detailed description of the preferred embodiments of the invention in conjunction with the accompanying drawings, in which.

BEST MODE FOR CARRYING OUT THE INVENTION

Figure 1:
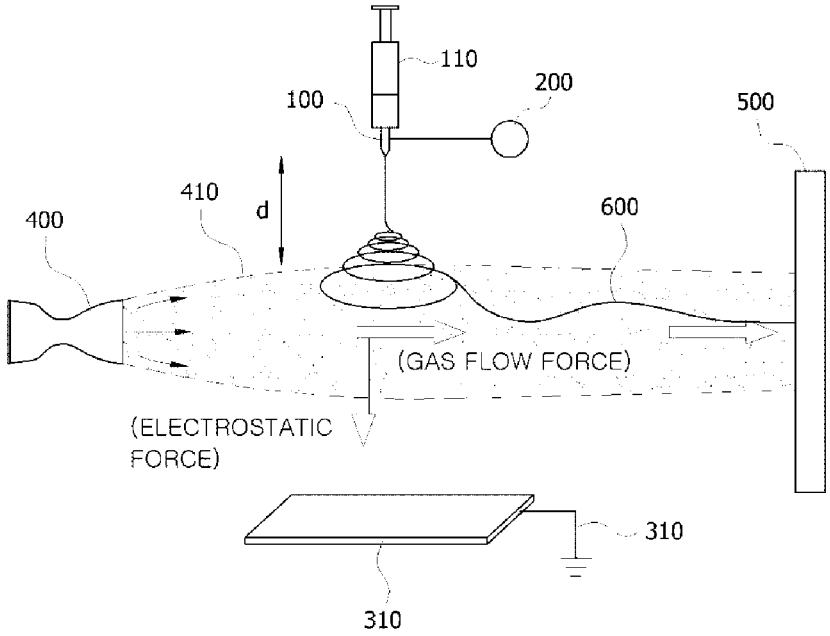
FIGS. 1 and 2 are conceptual views illustrating the configuration of an electrospinning device according to one embodiment of the present invention.

Now, preferred embodiments of the present invention will be described hereinafter in detail with reference to the accompanying drawings. It should be noted that the same elements in the drawings are denoted by the same reference numerals although shown in different figures. In the following description, the detailed description on known function and constructions unnecessarily obscuring the subject matter of the present invention will be avoided hereinafter.

Figure 2:
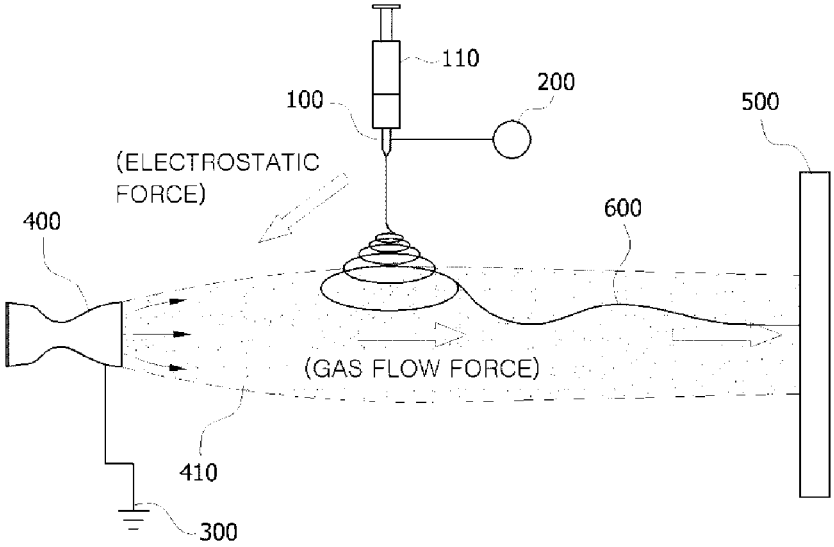
Figure 3:
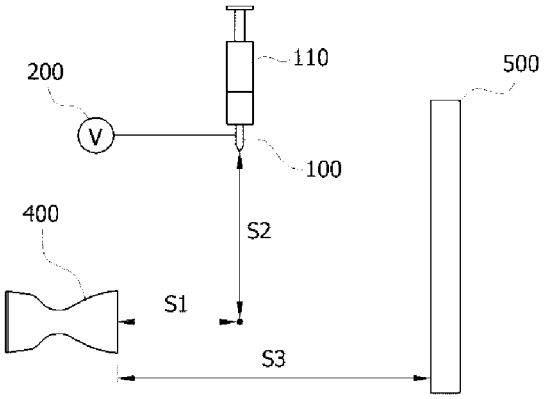
FIGS. 3 and 4 are views illustrating an experimental condition of a first experiment using an electrospinning device according to one embodiment of the present invention and an experimental result according to the experimental condition.
Figure 4:
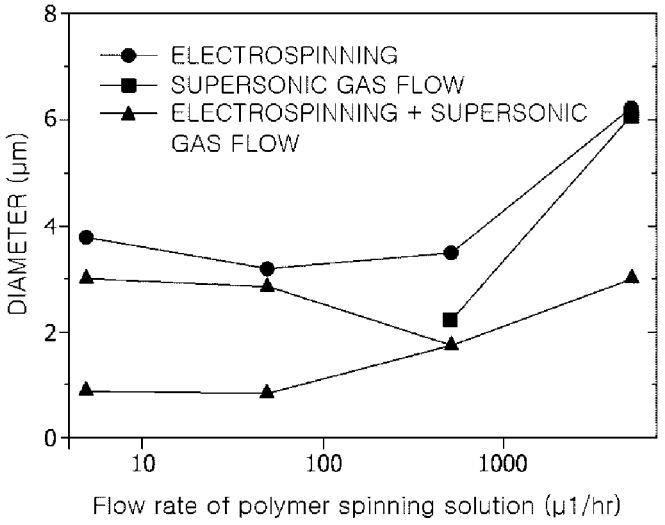

FIGS. 1 and 2 are conceptual views illustrating the configuration of an electrospinning device according to one embodiment of the present invention, and FIGS. 3 and 4 are views illustrating an experimental condition of a first experiment using an electrospinning device according to one embodiment of the present invention and an experimental result according to the experimental condition.

An electrospinning device according to one embodiment of the present invention is a device that can uniformly collect supermicro fibers having a diameter of 100 nm or less. The electrospinning device includes an electrospinning nozzle 100, a high voltage generator 200, a ground plate 310, a gas spray nozzle 400, and a collector 500. The electrospinning nozzle 100 is configured to discharge a polymer spinning solution by being applied with a high voltage so that the polymer spinning solution forms a fiber. As shown in FIG. 1, the electrospinning nozzle 100 is configured to be supplied with the polymer spinning solution from a polymer spinning solution supply unit 110 and discharge the polymer spinning solution to the outside thereof. For example, the polymer spinning solution supply unit can use a syringe pump that supplies the polymer spinning solution in a fixed quantity, and the electrospinning nozzle 100 can employ a cone-jet nozzle that is supplied with the polymer spinning solution from the syringe pump and discharges the polymer spinning solution to the outside thereof.

The polymer spinning solution can use a solution used in a general electrospinning device. For example, a solution in which polyvinyl alcohol (PVA) and water are mixed with each other can be used as the polymer spinning solution. In the case where a polymer having an excellent mechanical property such as nylon is used, a strong acid solution such as formic acid may be used. In this case, a separated hood (not shown) may be included in order to prevent the polymer spinning solution from being discharged to an external space of the device in the process in which the polymer spinning solution is discharged and collected.

The high voltage generator 200 applies a high voltage to the electrospinning nozzle 100, and a separate to ground power source 300 are disposed at a position spaced apart from the electrospinning nozzle 100 to correspond to the high voltage generator 200. The ground power source 300 may be connected to a separate ground plate 310 to form an electric field in a space between the ground plate 310 and the electrospinning nozzle 100 as shown in FIG. 1, or may be connected to the gas spray nozzle 400 for an electric field in a space between the gas spray nozzle 400 and the electrospinning nozzle 100 as shown in FIG. 2. A fiber 600 discharged from the electrospinning nozzle 100 according to the formed electric field is induced to flow toward the ground plate 310 or the gas spray nozzle 400 from the electrospinning nozzle 100 by an electrostatic force.

For example, as shown in FIG. 1, in the case where the electrospinning nozzle 100 is disposed at an upper portion of the electrospinning device, and the ground power source 300 is connected to the ground plate 310 disposed at a lower portion of the electrospinning device so as to be positioned vertically just below the electrospinning nozzle 100, the fiber discharged from the electrospinning nozzle 100 is applied with a high voltage from the high voltage generator 200 to take an electric charge. Thus, while the electrostatic force downwardly acts on the discharged fiber by the electric field formed between the electrospinning nozzle 100 and the ground plate 310, the fiber is induced to flow toward the ground plate 310.

In addition, as shown in FIG. 2, in the case where the ground power source 300 is connected to the gas spray nozzle 400, the fiber discharged from the electrospinning nozzle 100 is induced to flow toward the gas spray nozzle 400 based on the same principle as that in FIG. 1.

The gas spray nozzle 400 is configured to spray a gas in direction different from that of the electrostatic force of the electric field. In this case, the flow rate of the gas sprayed is configured to have a flow rate of about 300 m/s or more in a supersonic flow having a Mach number greater than 1. Thus, the fiber discharged from the electrospinning nozzle 100 receives a force induced by the electrostatic force and simultaneously receives a force induced by the flow of the gas sprayed from the gas spray nozzle 400. At this time, the force induced by the flow of the sprayed gas is larger than that induced by the electrostatic force.

In addition, a direction of the electrostatic force caused by the electric force acting on the fiber 600 discharged from the electrospinning nozzle 100 and a direction of the flow force of the gas caused by the gas spray nozzle 400 can be formed to have a predetermined angle with respect to each other. The predetermined angle can be set to form a right angle as shown in FIG. 1. In a configuration of the ground plate 310 disposed so as to be opposed to the electrospinning nozzle, the direction of the electrostatic force and the direction of the gas flow force can be formed so as to be perpendicular to each other so that the fiber discharged from the electrospinning nozzle is introduced into a gas flow layer. The predetermined angle between the direction of the electrostatic force of the electrospinning nozzle and the direction of the gas flow force may be adjusted properly in consideration of the structure of the ground power source, and the distance between the gas spray nozzle and the electrospinning nozzle.

The collector 500 is configured to collect the fiber 600 discharged from the electrospinning nozzle 100 thereon. The collector 500 may be configured in the form a glass substrate, or the like. The fiber 600 discharged from the electrospinning nozzle 100 may be collected in the form of a web on the collector 500. The collector 500 is preferably disposed at a position opposed to that of the gas spray nozzle 400 along the flow direction of the gas sprayed from the gas spray nozzle 400 according to one embodiment of the present invention.

By virtue of this configuration, according to the electrospinning device according to one embodiment of the present invention, in the process in which the fiber 600 discharged from the electrospinning nozzle 100 is induced to the ground plate 310 or the gas spray nozzle 400 by the electrostatic force, the fiber 600 discharged from the electrospinning nozzle 100 receives the flow force of the gas sprayed from the gas spray nozzle 400, which acts in a direction perpendicular to the direction of the electrostatic force, to cause a shear stress to be applied to the fiber 600 by the gas flow so that a diameter of the fiber is made smaller and thus the fiber has a finer diameter.

In this case, as described above, since the gas flow force greater than the electrostatic force acts on the fiber 600, the fiber 600 flows along the flow direction of the gas by the gas flow force in the induction process of the fiber by the electrostatic force. Thus, the collector 500 that collects the fiber 600 is disposed so as to be opposed to the gas spray nozzle 400 along the flow direction of the gas sprayed from the gas spray nozzle 400 so as to collect fibers thereon unlike the conventional prior art.

The electrospinning device as constructed above enables a shear stress to be exerted to the fiber 600 discharged from the electrospinning nozzle 100 by the flow of the gas so that fibers having a finer diameter, for example, a diameter of 100 nm or less can be uniformly obtained.

In the meantime, the state of the fiber 600 may vary depending on the positions of the electrospinning nozzle 100 and the gas spray nozzle 400. The electrospinning nozzle 100 and the gas spray nozzle 400 are preferably disposed so as to prevent the electrospinning nozzle 100 from acting as an obstructing element that obstructs the flow of the gas sprayed from the gas spray nozzle 400. To this end, the electrospinning nozzle 100 may be disposed in such a manner as to be vertically spaced apart by a predetermined distance d from a flow layer 410 of the gas sprayed from the spray nozzle 400 as shown in FIG. 1.

An experimental condition of a first experiment and an experimental result according to the experimental condition are shown in FIGS. 3 and 4. The first experiment was conducted under two conditions in which the collector 500 is constantly held in a fixed position, and the relative positions of the gas spray nozzle 400 and the electrospinning nozzle 100 are changed. The respective experimental results are compared with each other in case of using only the electrospinning nozzle 100, in case of using only the gas spray nozzle 400, and in case of both the electrospinning nozzle 100 and the gas spray nozzle 400. The above three cases are compared and experimented with variously changing the flow rate of the polymer spinning solution supplied.

As shown in FIG. 4, it can be found that in case of collecting the fiber 600 by using only the electrospinning nozzle 100, the diameter of the fiber 600 is relatively large. It can also be seen that in case of collecting the fiber 60 based on the effect of the supersonic gas flow by using only the gas spray nozzle 400, the diameter of the fiber 600 is relatively large. On the other hand, it can be seen from FIG. 4 that in case of collecting both the electrospinning nozzle 100 and the gas spray nozzle 400, the fiber 600 has a finer diameter in its entirety. Particularly, it can be seen through the experimental results under conditions 1 and 2 that a fiber having a finer diameter can be collected on the collector 500 in the case where the electrospinning nozzle 100 is positioned spaced apart by a predetermined distance from the flow layer of the gas sprayed from the gas spray nozzle 400.

Figure 5:
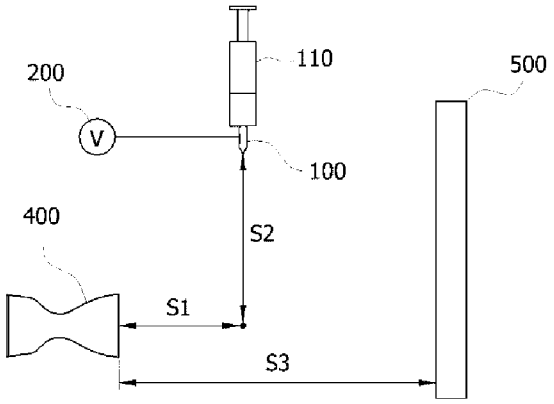
FIGS. 5 and 6 are views illustrating an experimental condition of a second experiment using an electrospinning device according to one embodiment of the present invention and an experimental result according to the experimental condition.
Figure 6:
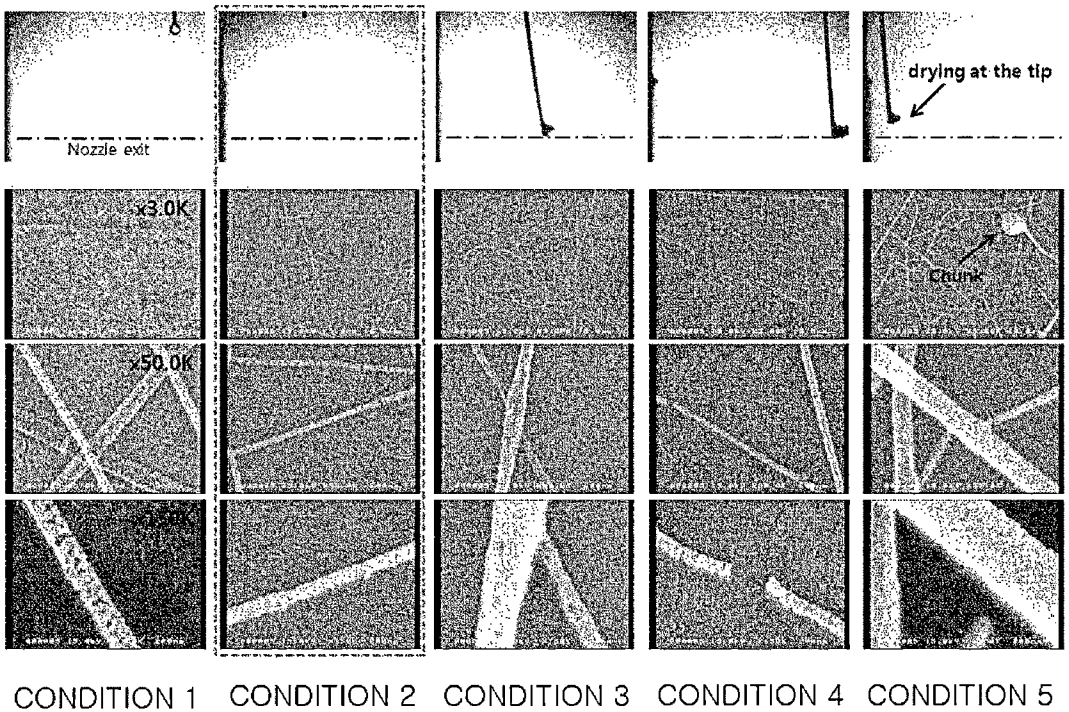

FIGS. 5 and 6 are views illustrating an experimental condition of a second experiment using an electrospinning device according to one embodiment of the present invention and an experimental result according to the experimental condition;

The second experiment shown in FIGS. 5 and 6 was conducted under five experimental conditions with variously changing the relative positions of the electrospinning nozzle 100 and the gas spray nozzle 400. The state of the fiber 600 collected under the respective experimental conditions is shown in FIG. 6.

Under condition 1, the diameter of the fiber 600 is smaller than 100 nm, which is relatively fine, but the fiber 600 is not uniform due to a difference in its diameter. In addition, under conditions 3, 4 and 5, the experimental results show that the diameter of the fiber 600 is relatively large or the amount of the fiber 600 collected is very small. On the contrary, under condition 2, the experimental result shows that the diameter of the fiber 600 ranges from 50 to 100 nm so that finer and more uniform fibers can be collected as well as the amount of the fiber collected is relatively large.

It can be seen from these experimental results that the fiber 600 discharged from the electrospinning nozzle 100 is preferably positioned adjacent to the gas spray nozzle 400 relative to the flow direction of the gas sprayed from the gas spray nozzle 400. Of course, it is to be noted that even in this case, the electrospinning nozzle 100 is preferably disposed so as to be vertically spaced apart from the gas flow layer 410 as described above. In other words, S2 is preferably set to be greater than a predetermined distance so as to be spaced apart from the gas flow layer 410 based on the experimental conditions shown in FIG. 5. In this state, S1 is preferably set to be small so that the fiber 600 discharged from the electrospinning nozzle 100 is adjacent to the gas spray nozzle 400.

Consequently, the electrospinning nozzle 100 is disposed in such a manner as to be vertically spaced apart by a predetermined distance from the flow layer 410 of the gas sprayed from the spray nozzle 400. Further, the fiber 600 discharged from the electrospinning nozzle 100 is preferably disposed in such a manner as to be positioned adjacent to the gas spray nozzle 400 along the flow direction of the gas sprayed from the gas spray nozzle 400.

In the aforementioned experiments shown in FIGS. 5 and 6, a mixture was used in which nylon is added to a formic acid solution in an amount of 20 wt %. Alternatively, the experimental results shown in FIGS. 7 to 9 show that a mixture was used in which nylon is added to a formic acid solution in an amount of 10 wt % and 15 wt %.

Figure 7:
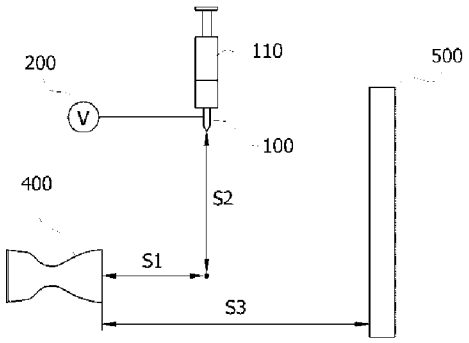
FIGS. 7 to 9 are views illustrating an experimental condition of a third experiment using an electrospinning device according to one embodiment of the present invention and an experimental result according to the experimental condition.
Figure 8:
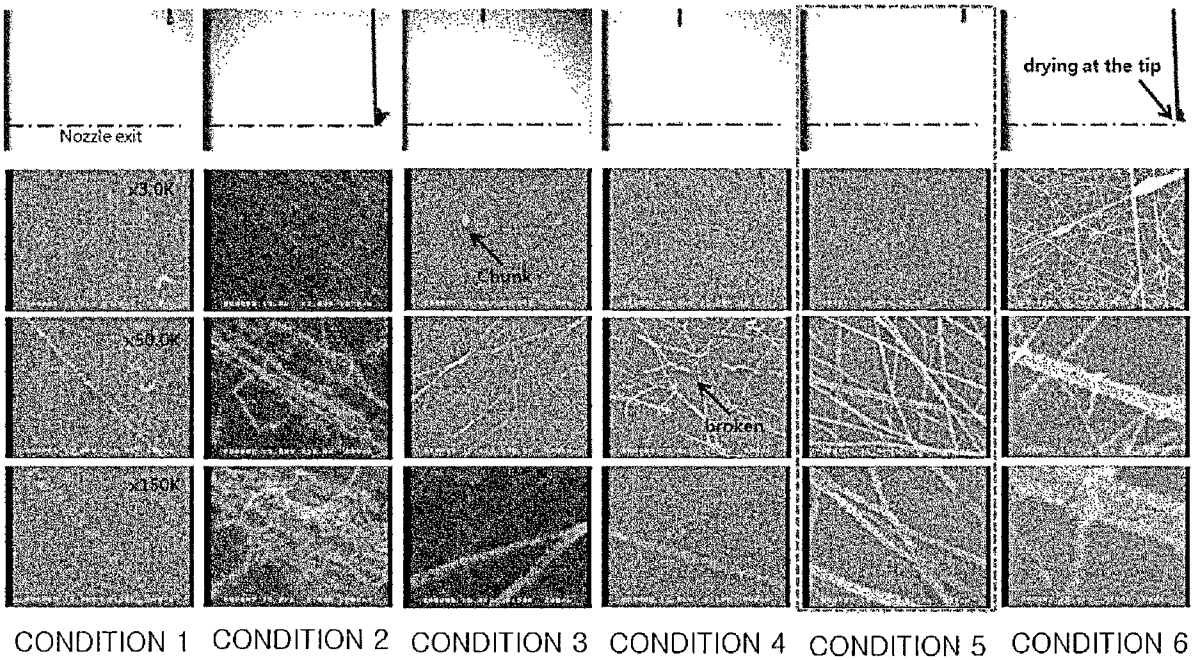
Figure 9:
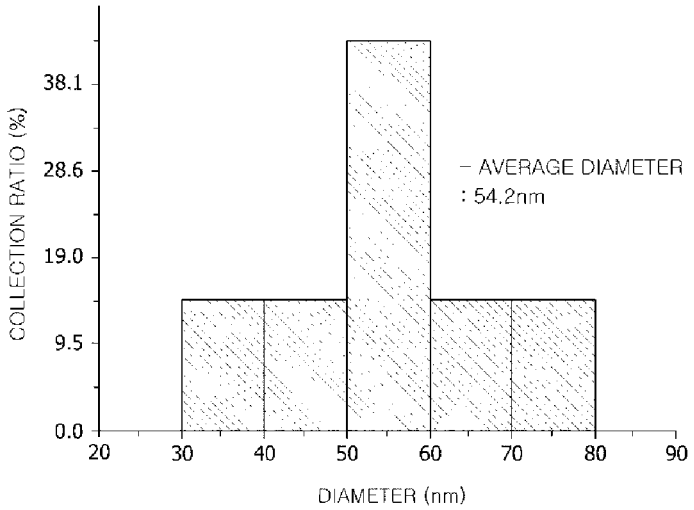

FIGS. 7 to 9 are views illustrating an experimental condition of a third experiment using an electrospinning device according to one embodiment of the present invention and an experimental result according to the experimental condition.

In the third experiment, nylon is added in an amount of 10 wt % under conditions 1, 2 and 3, and nylon is added in an amount of 15 wt % under conditions 4, 5 and 6. Moreover, the third experiment was conducted with changing values of S1 and S 2 in a state in which S3 is set to have the same value under the respective conditions.

It can be seen from the experimental results shown in FIGS. 7 to 9 that finest and most uniform fibers were collected under condition 5. In other words, the experimental results show that the collection ratio of the fiber is relatively high as well as the diameter of the fiber collected ranges from 40 to 50 nm, which are very fine and is small in its deviation so that fibers having a relatively uniform diameter can be obtained under condition 5. In a graph of FIG. 9, there are shown the range of the diameter and the collection ratio of the fiber collected under condition 5. In addition, it can be seen from FIG. 8 that there occurs no phenomenon in which the fiber is cut off in the collection process of the fiber under condition 5 unlike other conditions.

Meanwhile, it can be seen from the experimental result of the third experiment that the electrospinning nozzle 100 is preferably disposed in such a manner as to be vertically spaced apart by a predetermined distance from the flow layer 410 of the gas sprayed from the spray nozzle 400 as described above.

In addition, it has been described in the above embodiment that the electrospinning device is configured such that the polymer spinning solution discharged from the electrospinning nozzle is collected along the flow direction of the gas sprayed from gas spray nozzle. In this case, since the gas sprayed from the gas spray nozzle has a significant difference in the flow rate depending on the flow position thereof, the polymer spinning solution discharged from the electrospinning nozzle can be induced to the central position of the gas flow layer to maximize the collection ratio of the fiber on the collector.

Figure 10:
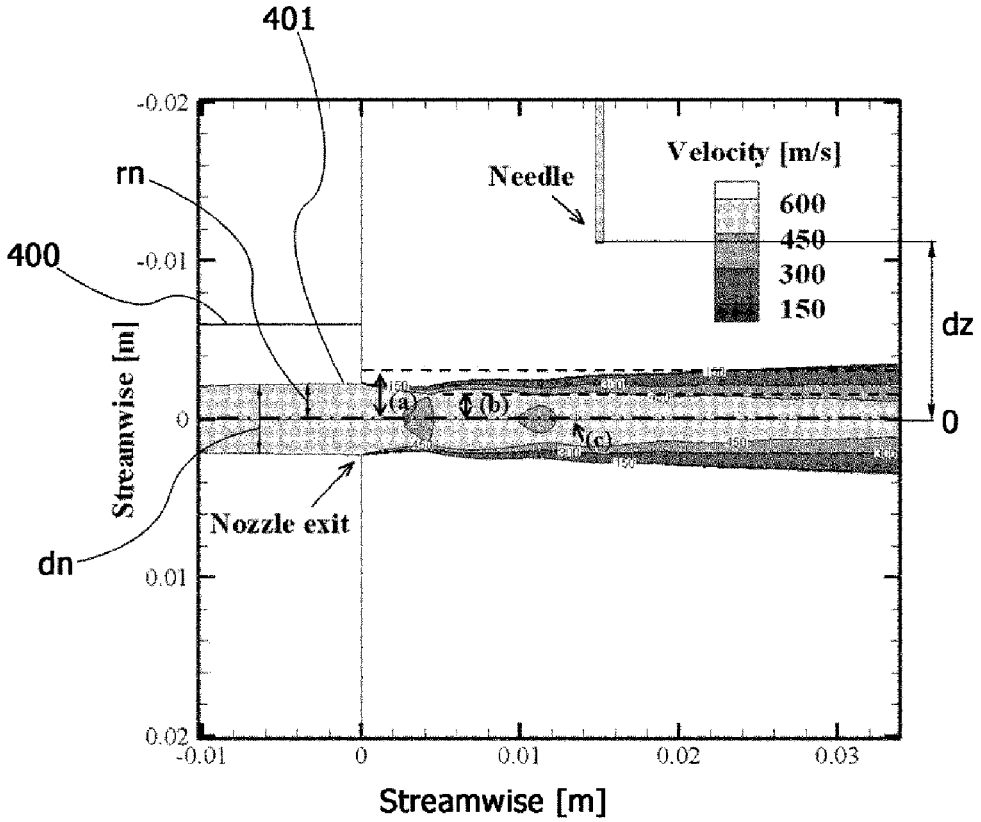
FIG. 10 is a schematic state diagram illustrating the flow rate of a gas discharged from a gas spray nozzle of the present invention.

In other words, in FIG. 10, there is shown a diagrammatic view illustrating analysis of the flow rate of the gas sprayed from the gas spray nozzle. In the flow of the gas discharged from a nozzle exit or a nozzle discharge port 401 of the gas spray nozzle 400, a change in the flow rate of the gas according to a change in the distance (indicated by reference symbols (a), (b) and (c) (a>b>c)) from a central line O-O is shown in Table 1 below.

TABLE 1

| | Distance (mm) from Central line O-O | Average flow rate(m/s) |
|---|---|---|
| (a) | 3 | 119.37 |
| (b) | 1.5 | 424.75 |
| (c) | 0 | 457.89 |

That is, as it goes away from the center of the gas flow layer, the flow rate of the gas discharged is sharply decreased. The polymer spinning solution discharged from the electrospinning nozzle positioned spaced apart by a distance indicated by a reference symbol dz from the central line O-O is preferably allowed to approach the center of the gas flow layer so that the polymer spinning solution receives a sufficient speed energy from the gas flow and is focused to the collector 500.

Figure 11:
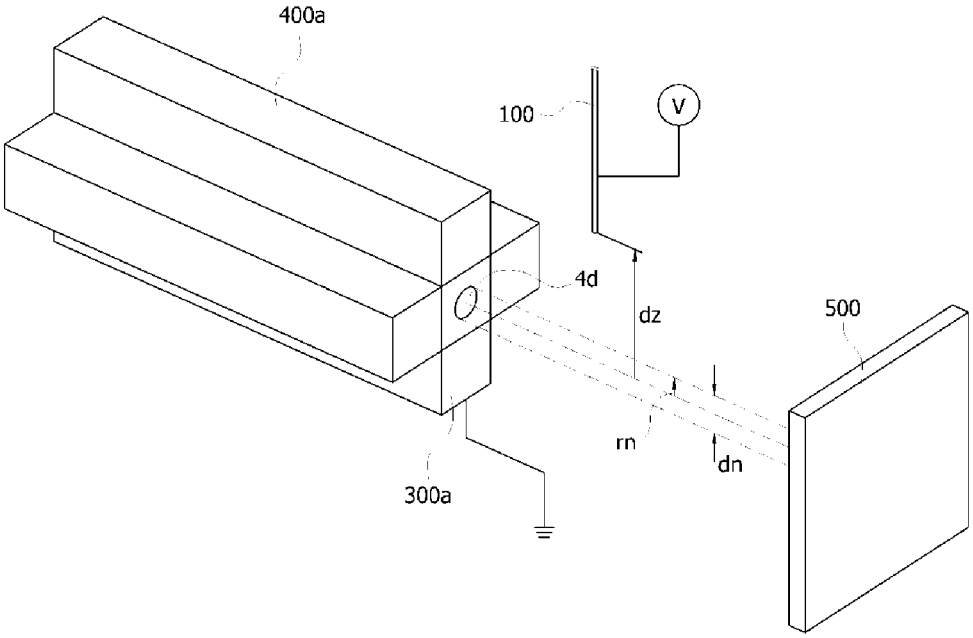
FIG. 11 is a schematic perspective view illustrating an electrospinning device according to another embodiment of the present invention.

To this end, an electrospinning device 10*a* according to another embodiment of the present invention as shown in FIG. 11 includes an electrospinning nozzle 100, a high voltage generator 200, a ground power source 300*a*, a gas spray nozzle 400*a*, and a collector 500. In this embodiment, the same elements as those in the above-mentioned embodiment are designated by the identical reference numerals and the detailed description thereof will be omitted to avoid redundancy.

A nozzle ground unit 310*a* is connected to the ground power source 300*a* and is disposed at the outside of the gas spray nozzle 400*a*. The ground power source 300*a* is connected to the nozzle ground unit 310*a* so that the fiber discharged from the electrospinning nozzle 100 is induced to flow toward the gas spray nozzle 400*a* by the electrostatic force.

The nozzle ground unit 310*a* is disposed at the outside of the gas spray nozzle 400*a* as shown in FIG. 11. In the case where the gas spray nozzle 400*a* is formed of a steel material such as stainless steel, the electrospinning device may be modified in various manners, such as taking a structure in which the remaining elements are insulated by a shielding material except the nozzle ground unit 310*a* of the ground power source 300*a*.

Figure 13:
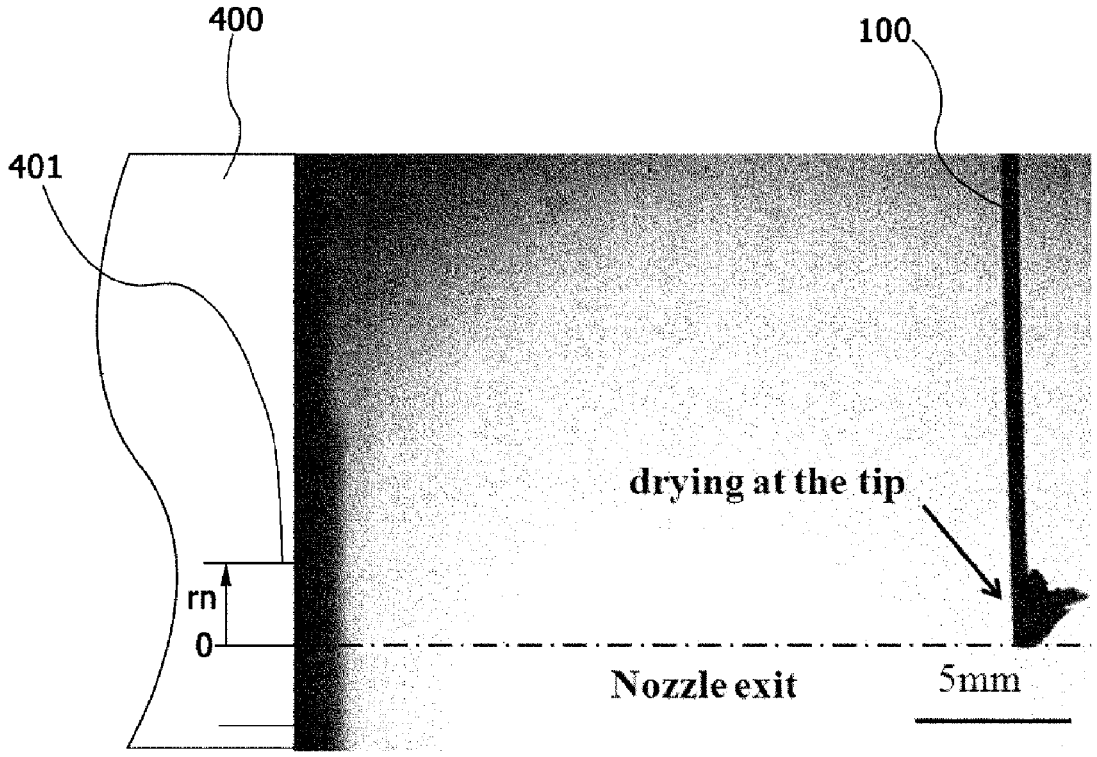
FIGS. 13 and 14 are diagrammatic view illustrating a state in which the tip of an electrospinning nozzle of an an electrospinning device according to another embodiment of the present invention enters the inside of a sprayed gas flow layer and a simulation structure thereof.
Figure 14:
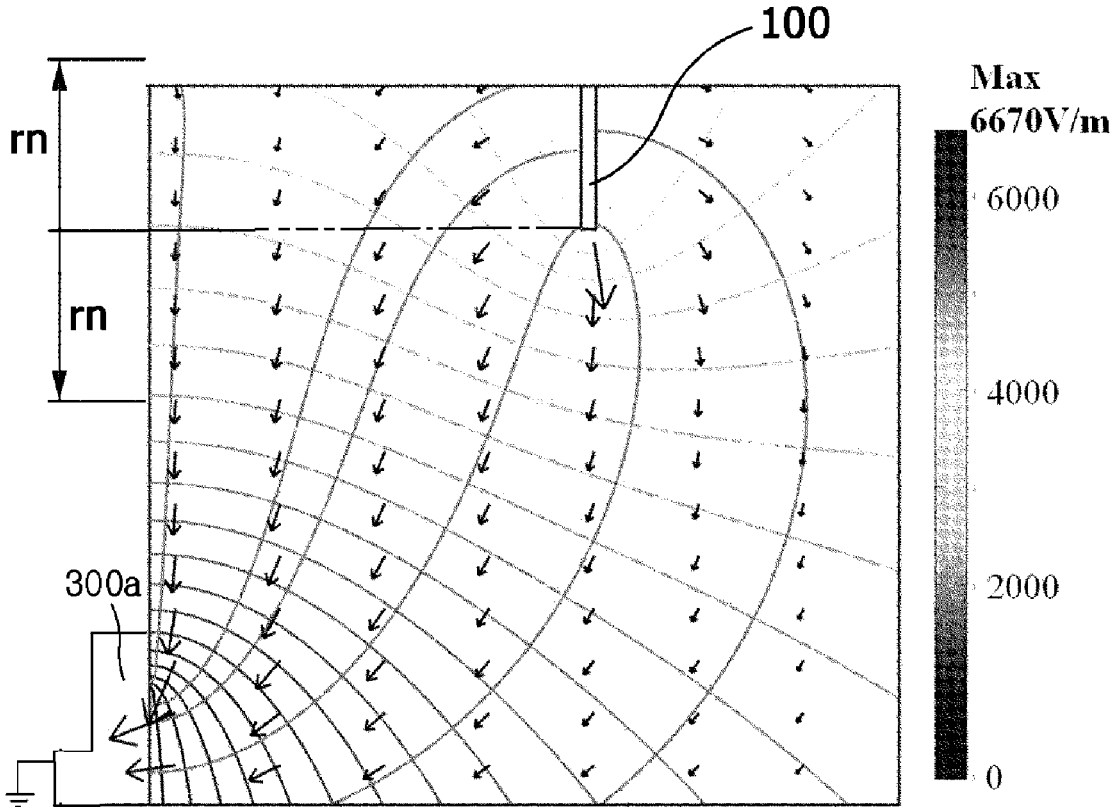

In this embodiment, there has been illustrated a structure in which the ground power source 300*a* connected to the nozzle ground unit 310*a* is provided in single number at a lower end of the gas spray nozzle, which is opposed to the electrospinning nozzle 100 with and a central line formed by the nozzle discharge port 401 being interposed between the ground power source 300*a* and the electrospinning nozzle 100, but the electrospinning device may be modified in various manners, such as taking a structure in which the ground power source 300*a* is disposed circumferentially relative to and equidistantly from the nozzle discharge port 401 of the gas spray nozzle 400*a*. The electrospinning nozzle 100 is disposed spaced apart by a distance indicated by a reference symbol dz from the central line formed by the nozzle discharge port 401 of the gas spray nozzle 400*a*. If a radius of the nozzle discharge port 401 is indicated by a reference symbol rn and a diameter of the nozzle discharge port 401 is indicated by a reference symbol dn, dz has a value greater than rn or dn, for example, a value greater than 1.54dn in order to prevent the tip of the electrospinning nozzle 100 from entering a range of the nozzle discharge port of the gas spray nozzle 400*a*. That is, in FIGS. 13 and 14, there has been shown an experiment and a simulation result in the case where the tip of the electrospinning nozzle 100 enters a range of the nozzle discharge port 401 of the gas spray nozzle 400*a*. In this case, the ground power source 300*a* including the nozzle ground unit 310*a* is disposed at a lower end of the gas spray nozzle 400*a*, and the tip of the electrospinning nozzle 100 is positioned on or adjacent to the central line O-O of the nozzle discharge port 401 so that an aim of an original design is intended to allow the polymer spinning solution discharged from the electrospinning nozzle 100 to be induced to flow toward the ground power source 300*a* as indicated by a dotted line in FIG. 14, in which process the polymer spinning solution is focused toward the collector 500 (see FIG. 11) by a high flow rate at the central portion of the gas flow layer. But as an actual experimental result shown in FIG. 13, in the case where the tip of the electrospinning nozzle 100 is present within the range of the nozzle discharge port 401 of the gas spray nozzle 400*a*, there occurs a problem in that the solvent contained in the spinning solution discharged from the electrospinning nozzle 100 evaporates quickly to cause the spinning solution to be rapidly coagulated at the tip of the electrospinning nozzle 100 to thereby block the discharge of the spinning solution. Therefore, the tip of the electrospinning nozzle 100 according to the present invention is preferably disposed in such a manner as to be spaced apart by a sufficient distance from the central line of the gas spray nozzle 400*a* in order to prevent from entering the range of the nozzle discharge port 401.

Figure 12:
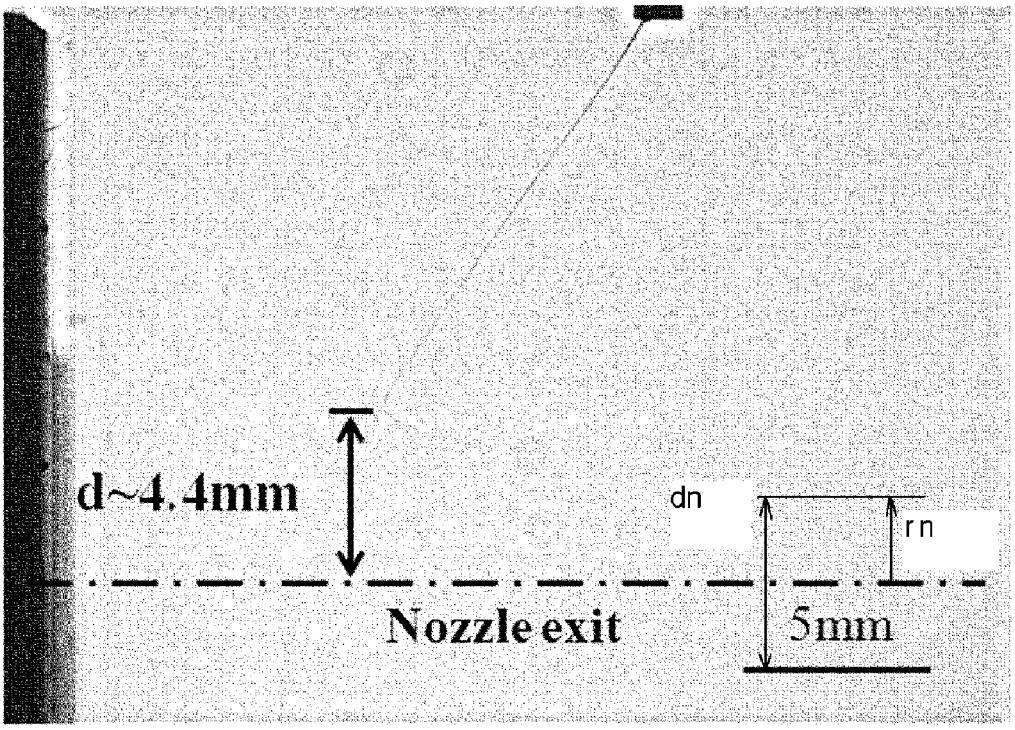
FIG. 12 is a state diagram illustrating the state of a polymer spinning solution induced to the center of a gas spray nozzle of an electrospinning device according to another embodiment of the present invention.
Figure 15:
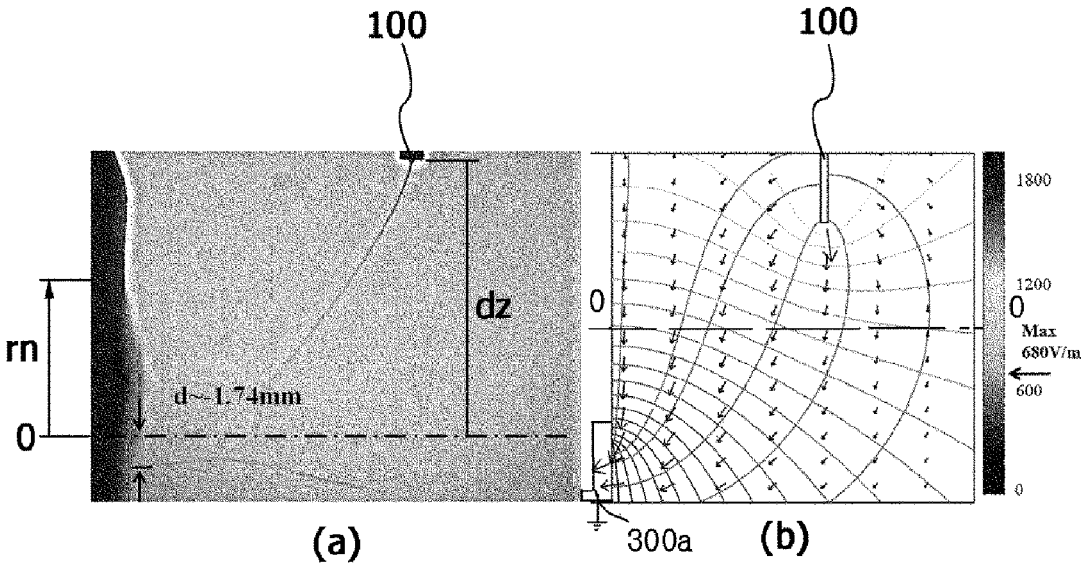
FIG. 15 is a state diagram illustrating a state in which a polymer spinning solution is induced to a lower end of a gas spray nozzle of an electrospinning device according to another embodiment of the present invention.

Thus, in FIGS. 12 and 15, there is shown an experimental result in the case where the tip of the electrospinning nozzle 100 is disposed spaced apart by a predetermined distance from the central line of the gas spray nozzle 400*a* in order to prevent from entering the range of the nozzle discharge port 401. In other words, in FIG. 12, there is shown the case where when the nozzle ground unit of the ground power source is formed at the gas spray nozzle in its entirety, but not at th lower end of the gas spray nozzle so that the polymer spinning solution discharged from the electrospinning nozzle 100 is not present in the gas flow layer, the tip of the electrospinning nozzle 100 is adjusted to be oriented toward the nozzle discharge port 401. In addition, in FIG. 15, there is shown the case where when the nozzle ground unit of the ground power source is formed only at th lower end of the gas spray nozzle so that the polymer spinning solution discharged from the electrospinning nozzle 100 is not present in the gas flow layer, the tip of the electrospinning nozzle 100 is adjusted to be oriented toward the lower end of the nozzle discharge port 401. In case of FIG. 12, the polymer spinning solution discharged from the electrospinning nozzle 100 does not enter the central portion of the flow layer of the gas sprayed from the gas spray nozzle 400*a*. On the other hand, in cases of FIG. 15, the polymer spinning solution discharged from the electrospinning nozzle 100 induced to flow toward the lower end of the gas spray nozzle 400*a* through the ground power source 300*a* connected to the nozzle ground unit 310*a* disposed at the lower end of the gas spray nozzle 400*a* so that the progress direction of the is changed at the central portion of the nozzle discharge port 401 of the gas spray nozzle 400*a* to cause the polymer spinning solution to be induced to flow toward the collector 500. That is, in case of FIG. 15, when the discharge of the polymer spinning solution is performed in a state in which the ground power source 300*a* is connected to the lower end of the gas spray nozzle 400*a* to form a grounding state and a voltage is applied to the electrospinning nozzle 100 to form an electric field, the polymer spinning solution is moved toward the ground power source 300*a* connected to the lower end of the gas spray nozzle 400*a* and then is changed in direction by the flow force of the gas sprayed from the nozzle discharge port 401 of the gas spray nozzle 400*a* in such a manner that the direction of the polymer spinning solution is properly adjusted by the strength of the electric field formed between the ground power source 300*a* and the electrospinning nozzle 100, so that the polymer spinning solution is moved toward the central portion of the gas flow layer and enters a region having a high flow rate to cause the polymer spinning solution to be more smoothly and intensively focused toward the collector 500 (see FIG. 11), thereby forming a state in which the polymer fiber is stably and intensively collected on one surface of the collector 500.

As such, fibers having a reinforced structure can be obtained on the collector through the ground power source including the nozzle ground unit disposed at the lower end of the gas spray nozzle, which is opposed to the electrospinning nozzle 100 with the central line of the gas spray nozzle being interposed between the electrospinning nozzle and the ground power source disposed at the lower end of the gas spray nozzle.

Figure 16:
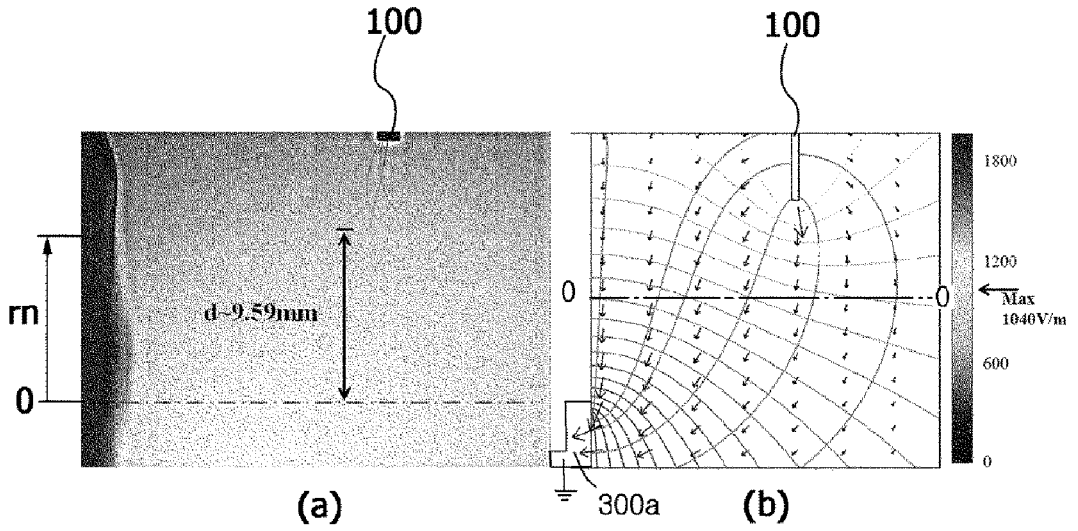
FIG. 16 is a state diagram illustrating a state in which an excessive voltage is applied to a polymer spinning solution induced to the center of a gas spray nozzle of an electrospinning device according to another embodiment of the present invention.

The electrospinning device having such a structure is designed such that the magnitude of a voltage applied to the electrospinning nozzle, the discharge pressure of the polymer spinning solution discharged from the electrospinning nozzle, and the flow rate of the gas sprayed from the gas spray nozzle through the nozzle discharge port must be adjusted in association with each other in order to achieve the optimal operation of the electrospinning device. Particularly, it is not preferable to excessively increase the magnitude of the voltage applied to the electrospinning nozzle in order to induce the polymer spinning solution discharged from the electrospinning nozzle to flow toward the central portion of the gas flow layer. In FIG. 16, there is shown an experiment and a simulation result of the case where the magnitude of the voltage applied to the electrospinning nozzle is increased by 53% compared to the case of FIG. 15. That is, as a result of an experiment in which the voltage applied to the electrospinning nozzle is boosted to induce the polymer spinning solution discharged from the electrospinning nozzle to flow toward the nozzle ground unit formed at the lower end of the gas spray nozzle as shown in FIG. 16(*b*) so that the stable induction of the polymer spinning solution discharged from the electrospinning nozzle toward the central portion of the gas flow layer is achieved even in the case where the gas flow force is increased by increasing the magnitude of the voltage applied to electrospinning nozzle, since a cone jet for stable spinning of the polymer spinning solution discharged from the tip of the electrospinning nozzle is not formed but a multi jet is formed as shown in FIG. 16(*a*) to cause an unstable spinning state, the excessive increase of the applied voltage is not desirable.

In the meantime, in the above-mentioned embodiments, there has been illustrated a structure in which the electrospinning device according to the present invention includes a single electrospinning nozzle, but the electrospinning nozzle may be provided in plural numbers.

Figure 17:
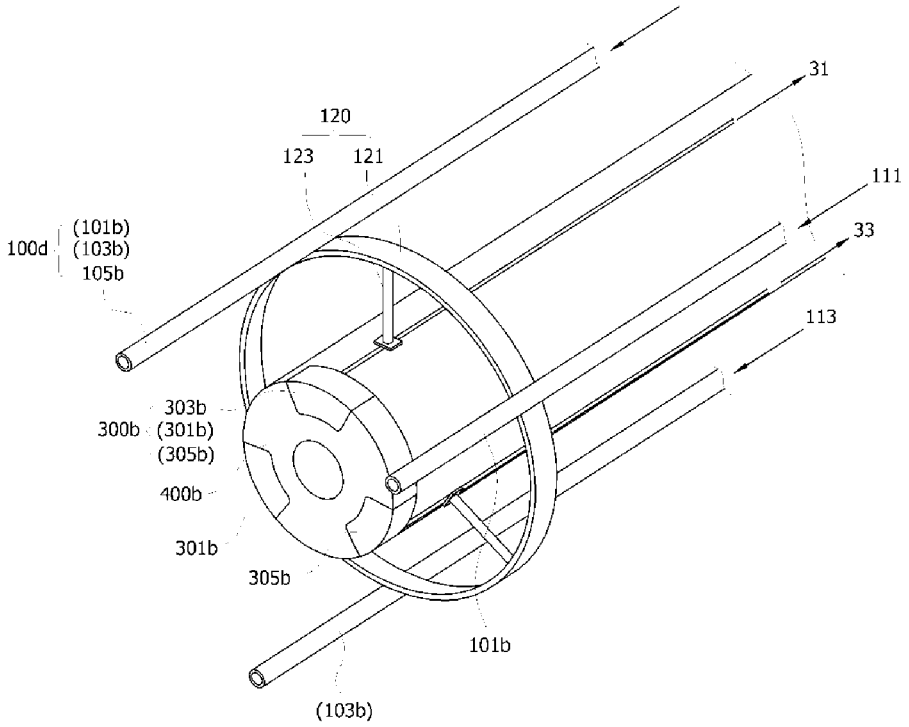
FIG. 17 is a schematic perspective view illustrating an electrospinning device according to an electrospinning device according to another embodiment of the present invention.

As shown in FIG. 17, a plurality of nozzle ground units 301*b*, 303*b* and 305*b* of a ground power source 300*b* is disposed around the tip of the gas spray nozzle 400*b* of the electrospinning device. In this embodiment, the electrospinning nozzle 100*d*; 101*b*,103*b*,105*b* is also provided in plural numbers. The nozzle ground units 301*b*, 303*b* and 305*b* are disposed circumferentially around the nozzle discharge port 401 of the gas spray nozzle 400 in such a manner that the electrospinning nozzles 101*d* and the nozzle ground units are interlaced with each other. In this case, each electrospinning nozzle forms a pair together with an associated one of the nozzle ground units. That is, each nozzle ground unit forms a state in which the nozzle ground unit and the ground power source are connected to each other in an interruptible manner. When the polymer spinning solution is discharged from one electrospinning nozzle forming a pair together with an associated one of the nozzle ground units, the associated nozzle ground unit is electrically conducted to form a grounding state so that the polymer spinning solution discharged from each electrospinning nozzle flows toward the nozzle ground unit disposed opposed to the each electrospinning nozzle, in which process, the polymer spinning solution passes through the range of the nozzle discharge port of the gas spray nozzle, so that a gas flow force of the central portion of the gas flow layer is exerted to the polymer spinning solution to cause the polymer spinning solution to be collected on the collector 500 (see FIG. 11). Like this, each pair consisting of one electrospinning nozzle and one nozzle ground unit is selectively operated so that a selective operation is performed in a sequence or order, thereby preventing a multi jet from being formed in the electrospinning nozzle to enable smooth spouting of the polymer spinning solution.

Here, the electrospinning nozzles can be supported by an electrospinning nozzle support unit 120. The electrospinning nozzle support unit 120 includes a frame 121 and a leg 123. The leg 123 is provided in plural numbers in such a manner that each leg 123 is connected at one end thereof to the outer circumferential surface of the gas spray nozzle 400*b* and is connected at the other end thereof to the inner circumferential surface of the frame 121. The frame 121 is implemented in a ring shape, and the electrospinning nozzles 100*b* are disposed on the outer circumferential surface of the frame 121. Each of the electrospinning nozzles 100*b*; 101*b*, 103*b*, 105*b* is connected to a voltage generator 200*b* by means of spinning nozzle wires 201, 203 and 205 so that a state of supplying a given voltage can be formed. Whether or not the voltage generator 200*b* applies the voltage to the electrospinning nozzles can be controlled in response to a voltage control signal of a control unit 20.

Figure 18:
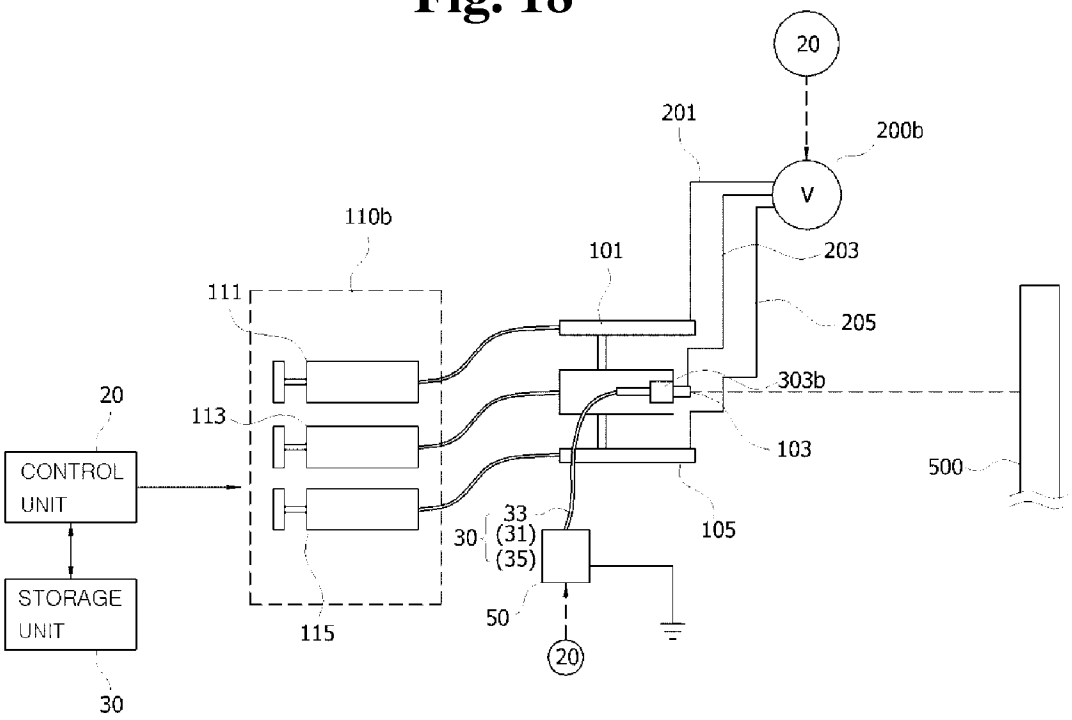
FIG. 18 is a block diagram illustrating the configuration of an electrospinning device according to another embodiment of the present invention.

In addition, a plurality of nozzle ground units 301*b*, 303*b* and 305*b* is disposed on the outer circumferential surface of the gas spray nozzle 400*b* in such a manner as to be spaced apart from each other at equal angular intervals relative to the nozzle discharge port 401 of the gas spray nozzle 400*b*. Further, the nozzle ground units 301*b*, 303*b* and 305*b* are connected to ground wires 30; 31, 33 and 35. Each of the ground wires 30; 31, 33 and 35 is connected to a ground power source interrupt unit 50 shown in FIG. 18 so that the interruption of power is controlled in response to a control signal from the control unit 20, thereby causing a change in the grounding state. In other words, as shown in FIG. 18, the electrospinning device according to the present invention can include a control unit 20 and a storage unit 30. The control unit 20 is connected to the voltage generator 200*b*, a polymer spinning solution supply unit 110*b*; 111, 113 and 115 for supplying a polymer spinning solution to the electrospinning nozzle, a gas spray nozzle 400*b*, and the ground power source interrupt unit 50 so as to apply a predetermined control signal to these elements so as to adjust a spinning state and a gas flow state, thereby enabling smooth collection of the fiber on the collector 500 and formation of a fibrous material. In addition, the storage unit 30 is connected to the control unit 20 so as to store data according to the operation mode, including predetermined data such as the amount of the polymer spinning solution discharged, the gas flow pressure/speed, and the interruption order of a ground power source interrupt unit, and applies the data to the control unit 20, thereby enabling a given smooth operation of the electrospinning device.

The embodiments as described above are merely illustrative and the invention is not limited to these embodiments. It will be appreciated by a person having an ordinary skill in the art that various equivalent modifications and variations of the embodiments can be made without departing from the spirit and scope of the present invention. Therefore, the true technical scope of the present invention should be defined by the technical spirit of the appended claims.

INDUSTRIAL APPLICABILITY

The electrospinning device according to the present invention can be utilized in a wide range of industrial applications in that it enables formation of high functional texture in industrial and medical products and daily, general purpose products.

The invention claimed is:

1. An electrospinning device comprising:

an electrospinning nozzle configured to discharge a polymer spinning solution by being applied with a high voltage in such a manner that the polymer spinning solution forms a fiber;

a high voltage generator configured to apply a high voltage to the electrospinning nozzle;

a ground power source configured to form an electric field in a space between the electrospinning nozzle and the ground power source so that the fiber discharged from the electrospinning nozzle is induced to flow in a predetermined direction by an electrostatic force;

a gas spray nozzle configured to spray a gas in one direction;

a collector configured to collect the fiber discharged from the electrospinning nozzle thereon, wherein the collector has a collection surface on which the fiber is collected, and the collection surface of the collector is disposed to face the gas spray nozzle along the flow direction of the gas sprayed from the gas spray nozzle, and the fiber discharged from the electrospinning nozzle is collected on the collection surface of the collector by the flow force of the gas sprayed from the gas spray nozzle, wherein the ground power source is connected to the gas spray nozzle so that the fiber discharged from the electrospinning nozzle is induced to flow toward the gas spray nozzle by the electrostatic force, wherein the gas spray nozzle is configured to spray the gas at supersonic flow speed to form a supersonic gas flow which moves toward the collector, and wherein the electrospinning nozzle is disposed to be spaced apart from the supersonic gas flow discharged from the gas spray nozzle.

2. The electrospinning device according to claim 1, wherein the direction of the electrostatic force by the electric field acting on the fiber discharged from the electrospinning nozzle and the direction of the flow force of the gas sprayed from the gas spray nozzle are formed so as to be perpendicular to each other.

3. The electrospinning device according to claim 1, wherein the fiber discharged from the electrospinning nozzle is positioned adjacent to the gas spray nozzle relative to the flow direction of the gas sprayed from the gas spray nozzle.

4. An electrospinning device comprising:

an electrospinning nozzle configured to discharge a polymer spinning solution by being applied with a high voltage in such a manner that the polymer spinning solution forms a fiber;

a high voltage generator configured to apply a high voltage to the electrospinning nozzle;

a ground power source configured to form an electric field in a space between the electrospinning nozzle and the ground power source so that the fiber discharged from the electrospinning nozzle is induced to flow in a predetermined direction by an electrostatic force;

a gas spray nozzle configured to spray a gas in one direction;

a collector configured to collect the fiber discharged from the electrospinning nozzle thereon, wherein the collector has a collection surface on which the fiber is collected, and the collection surface of the collector is disposed to face the gas spray nozzle along the flow direction of the gas sprayed from the gas spray nozzle, and the fiber discharged from the electrospinning nozzle is collected on the collection surface of the collector by the flow force of the gas sprayed from the gas spray nozzle, wherein a nozzle ground unit is disposed at the outside of the gas spray nozzle in such a manner as to be connected to the ground power source, and wherein the ground power source is connected to the nozzle ground unit so that the fiber discharged from the electrospinning nozzle is induced to flow toward the gas spray nozzle by the electrostatic force, wherein the gas spray nozzle is configured to spray the gas at supersonic flow speed to form a supersonic gas flow which moves toward the collector, wherein the nozzle ground unit is provided in plural numbers such that the plural nozzle ground units are concentrically disposed relative to the gas spray nozzle, and wherein the number of the electrospinning nozzle is the same as that of the nozzle ground unit, and the electrospinning nozzles are disposed circumferentially relative to and equidistantly from the gas spray nozzle in such a manner that the electrospinning nozzles and the nozzle ground units are interlaced with each other.

5. The electrospinning device according to claim 4, wherein the nozzle ground unit is provided in plural numbers such that the plural nozzle ground units are disposed concentrically with respect to the gas spray nozzle, and wherein the nozzle ground unit and the ground power source are connected to each other in an interruptible manner.

6. The electrospinning device according to claim 4, wherein each of the electrospinning nozzles forms a pair together with an associated one of the nozzle ground units that are disposed circumferentially around the gas spray nozzle in such a manner as to be interlaced with the electrospinning nozzles, so that each pair consisting of one electrospinning nozzle and one nozzle ground unit is selectively operated.

7. The electrospinning device according to claim 1, wherein:

the gas spray nozzle includes a nozzle discharge port disposed to face the collecting surface of the collector;

the nozzle discharge port discharges the supersonic gas flow in a direction towards the collecting surface of the collector; and the electrospinning nozzle is disposed between the nozzle discharge port and the collecting surface of the collector, such that the fiber discharged from the electrospinning nozzle is introduced into the supersonic gas flow and then is conveyed on the collecting surface of the collector along with the supersonic gas flow.

8. The electrospinning device according to claim 4, wherein:

the gas spray nozzle includes a nozzle discharge port disposed to face the collecting surface of the collector;

the nozzle discharge port discharges the supersonic gas flow in a direction towards the collecting surface of the collector; and the electrospinning nozzle is disposed between the nozzle discharge port and the collecting surface of the collector, such that the fiber discharged from the electrospinning nozzle is introduced into the supersonic gas flow and then is conveyed on the collecting surface of the collector along with the supersonic gas flow.

* * * * *